US005309976A

United States Patent [19]

Prichard et al.

[11] Patent Number: 5,309,976

[45] Date of Patent: May 10, 1994

[54] CONTINUOUS POUR DIRECTIONAL SOLIDIFICATION METHOD

[75] Inventors: Paul D. Prichard; Paul R. Aimone, both of Muskegon, Mich.

[73] Assignee: Howmet Corporation, Greenwich, Conn.

[21] Appl. No.: 33,274

[22] Filed: Mar. 16, 1993

[51] Int. Cl.[5] ..... B22D 25/00; B22D 27/04

[52] U.S. Cl. ..... 164/457; 164/122.1; 164/122.2

[58] Field of Search ..... 164/457, 122.1, 122.2

[56] References Cited

U.S. PATENT DOCUMENTS

Re. 30,979 6/1982 Watts .

3,268,958 8/1966 Sickbert .

*Primary Examiner*—Kuang Y. Lin

*Attorney, Agent, or Firm*—Flynn, Thiel, Boutell & Tanis

[57] ABSTRACT

A method of making a casting wherein a molten alloy is introduced into a mold cavity at an initial mold fill rate to partially fill the mold cavity while the mold cavity resides in a casting chamber. A solidification front is propagated through the molten alloy to provide a solidification rate. The remaining molten alloy is introduced into the mold at a second mold fill rate less than the first mold fill rate as the front propagates through the molten alloy. The second fill rate is controlled to correspond or be matched generally to the solidification rate of the molten alloy in the mold cavity.

16 Claims, 2 Drawing Sheets

CONTINUOUS POUR DIRECTIONAL SOLIDIFICATION METHOD

FIELD OF THE INVENTION

The present invention relates to a method for the directional solidification of a molten alloy to form a directionally solidified casting.

BACKGROUND OF THE INVENTION

Certain relatively large, complex gas turbine engine components, such as large turbine buckets for land based gas turbine engines, are difficult to manufacture with a directionally solidified (DS) grain structure, such as a columnar or single crystal (SC) grain structure, using well known DS casting techniques. The difficulty results from limitations associated with the investment shell mold strength and with control of melt heat transfer governing unidirectional solidification. The lack and/or loss of mold strength (e.g. mold slumping) during the casting process can result in dimensionally unacceptable cast components.

Moreover, the latest advanced single crystal superalloys include minor alloy additions of yttrium which reacts with the refractory materials commonly used in fabrication of the investment shell mold. Melt/mold reactions can be detrimental to casting chemistry and cleanliness.

It is an object of the present invention to provide an improved directional solidification casting method for making cast components that reduces mechanical stress on the mold and reduces melt/mold reaction effects by reducing contact time between the melt and the mold especially for highly reactive advanced DS and SC alloys.

SUMMARY OF THE INVENTION

The present invention provides a method of making a casting wherein a metallic melt such as molten alloy is introduced into a mold cavity of a preheated mold at an initial mold fill rate to partially fill the mold cavity while the mold resides in a casting chamber. A solidification front is propagated in a direction through the melt to provide a melt solidification rate. The remaining melt is introduced into the mold cavity at a second mold fill rate less than the initial mold fill rate and corresponding generally to the molten alloy solidification rate in the mold cavity. Typically, the second mold fill rate is controlled to correspond to the molten alloy solidification rate so as to maintain a constant molten alloy reservoir height above the solidification front, thereby reducing the metallostatic pressure on the mold.

In one embodiment of the invention, the melt is introduced at the aforementioned initial mold fill rate until about 10 to about 25% of the volume of a mold cavity is filled.

In another embodiment of the invention, the solidification front is established by mounting the mold on a chill member that extracts heat unidirectionally from the melt partially filling the mold to form a liquid/solid interface in the molten alloy constituting the solidification front. The solidification front propagates through the molten alloy at a solidification rate controlled by the speed of withdrawal of the mold from the casting furnace in accordance with the so-called withdrawal technique. Alternately, the solidification front advances through the molten alloy at a solidification rate controlled by reducing heat input to the melt in the mold in accordance with the so-called power down technique.

In still another embodiment of the invention, the molten alloy is introduced into the mold cavity by releasing the molten alloy from a bottom opening of a crucible into the mold disposed beneath the crucible. The mold fill rate is controlled by a stopper rod position relative to the bottom opening.

The present invention provides a method of making a casting wherein a melt is introduced into a mold cavity at an initial mold fill rate to partially fill the mold while the mold resides in a casting furnace. A solidification front is propagated in a direction through the molten alloy to provide a melt solidification rate, and the remaining molten alloy is introduced into the mold cavity at a second mold fill rate less than the first mold fill rate as the front propagates through the molten alloy.

The second mold fill rate is controlled in response to the position of the solidification front relative to the mold so as to be generally equal to the molten alloy solidification rate in the mold. Alternately, the second mold fill rate and the mold withdrawal rate from the casting chamber are controlled in response to the position of the solidification front so as to match the mold fill rate and molten alloy solidification rate.

The method of the present invention is advantageous in that improved casting dimensional control is achieved by reducing mold stresses and melt/mold reactions are reduced by reducing liquid melt/mold exposure or contact time. Moreover, the invention can provide improved control of melt solidification rates and casting crystal orientation with improved casting cleanliness attributable to bottom pouring of the melt into the mold.

These advantages of the present invention will become better understood by reference to the following detailed description when considered in conjunction with the accompanying drawings.

DETAILED DESCRIPTION

Figure 1:
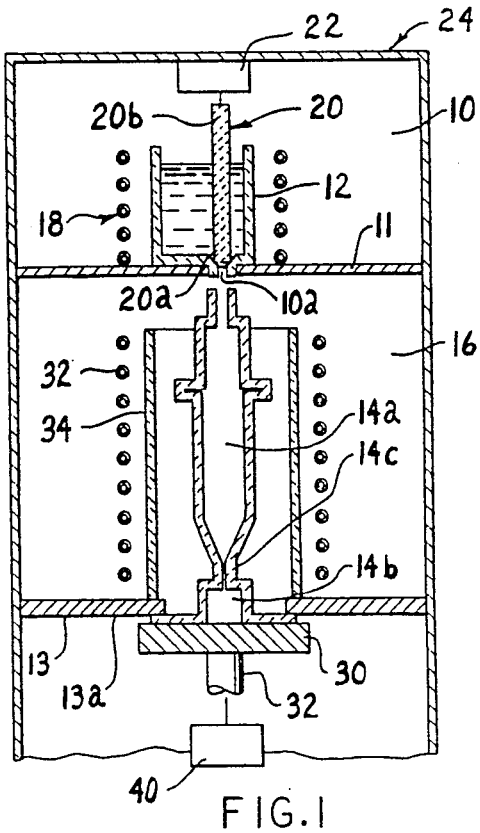
FIG. 1 is a sectioned, side view of apparatus for practicing one embodiment of the invention.

Referring to FIGS. 1–4, apparatus for practicing one embodiment of a method for making a directionally solidified casting, such as a columnar grain or single crystal grain casting, in accordance with the present invention is illustrated. The apparatus comprises a melting chamber 10 in which a melting crucible 12 is disposed on a housing partition 11 for melting a suitable charge, such, for example, as a nickel, cobalt or iron base superalloy, to provide a metallic melt such as molten alloy for casting into a preheated ceramic investment shell mold 14 disposed in the casting chamber 16 disposed below the melting chamber 10. The alloy charge is heated and melted in the crucible 12 by one or more induction coils 18 disposed in the chamber 10. The crucible can comprise a refractory or ceramic material or a water-cooled metallic (e.g. copper) material in accordance with commonly assigned U.S. Pat. No. 4 923 508 for use as an induction skull crucible.

The crucible 10 includes a bottom opening 10*a* for releasing the molten alloy when it is ready for casting; e.g. when the molten alloy reaches a suitable superheat for casting into the preheated mold 14. Flow of the molten alloy from the crucible 10 to the mold 14 is controlled by a vertically movable refractory stopper rod 20 having a lower end 20*a* received in the opening 10*a*. An upper end 20*b* of the stopper rod 20 is drivingly coupled to a suitable actuator 22, such as a hydraulic or pneumatic cylinder, electrical screw drive, or other actuator for raising and lowering the stopper rod 20 relative to the opening 10*a*. The actuator 22 can be mounted on the housing 24 inside the melting chamber 10, as shown, or outside the melting chamber 10 on the top of the housing 24. As will be explained herebelow, the stopper rod 20 is actuated to control the mold fill rate with molten alloy during the casting operation in accordance with the invention.

The casting chamber 16 is defined between the upper housing partition 11 and the lower housing partition 13. The lower housing partition 13 includes a central opening 13*a* through which the ceramic investment shell mold 14 is positioned in the casting chamber 16 for filling with molten alloy and then withdrawn for effecting directional solidification of the molten alloy in the mold 14. The mold 14 is made in accordance with the well known lost wax shell mold method and is shown in FIG. 1 for use in producing a single crystal casting. In particular, the mold 14 includes a mold cavity 14*a* having the configuration of the component to be cast. For example, in FIG. 1, the mold cavity 14*a* has a configuration to produce a gas turbine engine blade casting. For making a single crystal casting, the mold 14 includes a lower starter cavity 14*b* and a crystal selector section 14*c* which may comprise a so-called pigtail type crystal selector. In the starter cavity 14*b*, a plurality of solidified crystals or grains are initially nucleated upon contact of the molten alloy with the copper chill plate 30 supporting the mold 14. The crystals grow upwardly in the starter cavity 14*b* toward the selector section 14*c* where one of the crystals is selected for propagation through the molten alloy residing in the mold cavity 14*a* in a manner to be described herebelow.

Although the mold 14 is illustrated hereabove as having features for making a single crystal casting, the invention is not so limited and can be practiced using a mold configured in known manner to make a polycrystalline, columnar grain casting in accordance with well known columnar grain casting procedures.

The casting chamber 16 includes one or more induction coils 32 disposed therein and a graphite susceptor sleeve 34 disposed about the mold 14 for preheating the mold 14 to a desired casting temperature.

As mentioned, the mold is supported on the chill plate 30. The chill plate 30 is carried on a ram 32 that in turn is drivingly coupled to an actuator 40 such as a hydraulic or pneumatic actuator, electrical drive screw, or other actuator for raising or lowering the chill plate 30 and thus the mold 14 relative to the casting chamber 16. The speed of withdrawal of the molten alloy-filled mold 14 from the casting chamber 16 determines the speed at which the solidification front propagates through the melt; i.e. the molten alloy solidification rate in the mold.

Although the apparatus of FIG. 1 is illustrated for practicing directional solidification of the molten alloy by the so-called "withdrawal" procedure, the invention is not so limited and can be practiced using the so-called "power-down" procedure wherein multiple induction coils (not shown) disposed one above the other about the mold in the casting chamber are sequentially de-energized to reduce heat input to the molten alloy in a manner to effect the desired unidirectional solidification without movement of the mold relative to the casting chamber.

Figure 2:
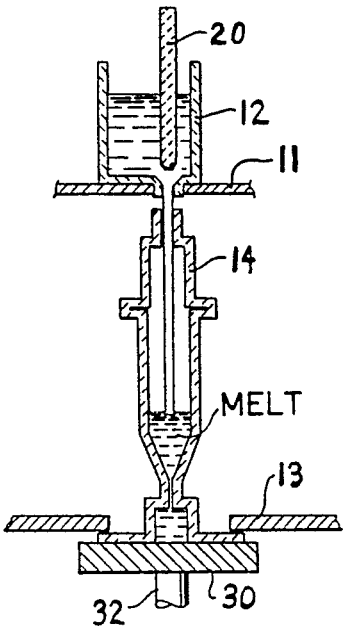
FIG. 2 is similar to FIG. 1 illustrating the melt being bottom poured into the investment mold at a first, relatively fast fill rate to partially fill the mold while the mold is positioned in the casting furnace on a chill plate.

In accordance with an embodiment of the method of the present invention, the superheated molten alloy in the crucible 12 is introduced into the mold 14 at an initial, relatively high mold fill rate as controlled by the position of the stopper rod 20 relative to the bottom crucible opening 12*a* to only partially fill the mold cavity 14*a* while the mold 14 resides in the casting chamber 16 as shown in FIG. 2. The starter cavity 14*b* and selector section 14*c* also are filled with the melt at this time as illustrated in FIG. 2. Preferably, only about 10 to about 25% of the volume of the mold cavity 14*a* is initially filled with the molten alloy at the first, higher fill rate.

Figure 3:
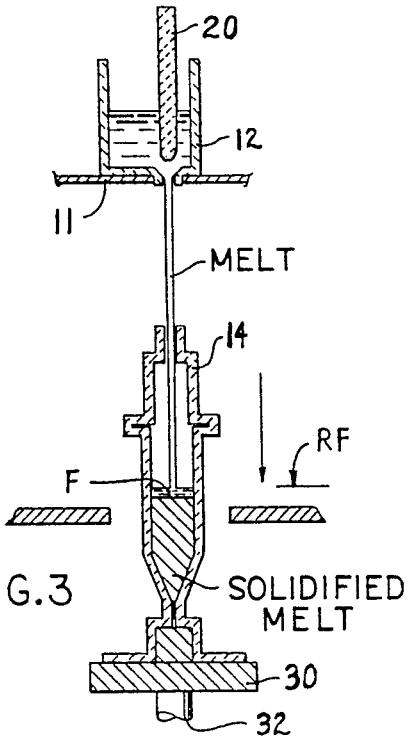
FIG. 3 is similar to FIG. 2 illustrating the melt being bottom poured into the mold at a second, relatively slower fill rate as the mold is withdrawn from the casting furnace to advance the solidification front through the melt.
Figure 4:
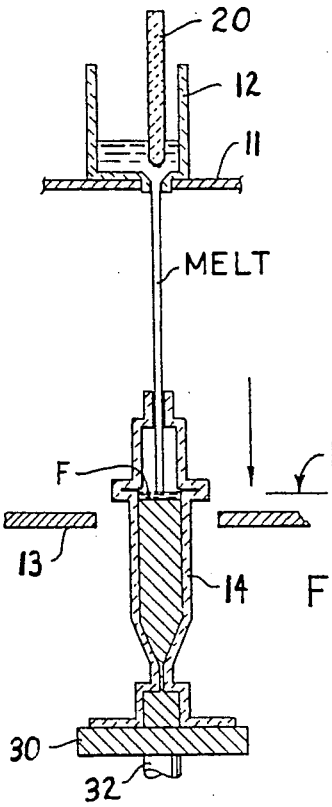
FIG. 4 is similar to FIG. 3 illustrating the melt still being bottom poured into the mold at the second, relatively slower fill rate as the mold is further withdrawn from the casting furnace to advance the solidification front through the melt.

Once the mold is partially filled in this manner, the remaining molten alloy (i.e. the amount needed to complete filling of the mold cavity 14*a*) is introduced from the crucible 12 into the mold 14 at a second, lower mold fill rate as withdrawal of the mold 14 from the casting chamber 16 is initiated to establish a solidification front F in the melt, see FIGS. 3–4.

The second mold fill rate is controlled by the position of the stopper rod 20 relative to the crucible bottom opening 12*a* and by the withdrawal speed of the mold 14 from the casting chamber 16 so as to correspond generally to the solidification rate of the molten alloy in the mold cavity 14*a* until the mold is filled with the molten alloy to the desired extent. The solidification rate corresponds to the propagation speed of the solidification front F in the molten alloy. Control of the second mold fill rate at a lower rate to generally match the molten alloy solidification rate is effective in maintaining a constant molten alloy reservoir height above the front F. The molten alloy solidification front F (i.e. liquid/solid interface) is maintained in a substantially constant location relative to a horizontal solidification front reference plane RF during withdrawal of the molten alloy-filled mold 14 from the casting chamber 16 as shown in FIGS. 3–4 for different mold withdrawal positions.

Exemplary initial and second mold fill rates in practicing the invention could be in the range of 10–50 lbs/min and 1–10 lbs/hr, respectively, depending on casting configuration.

Figure 5:
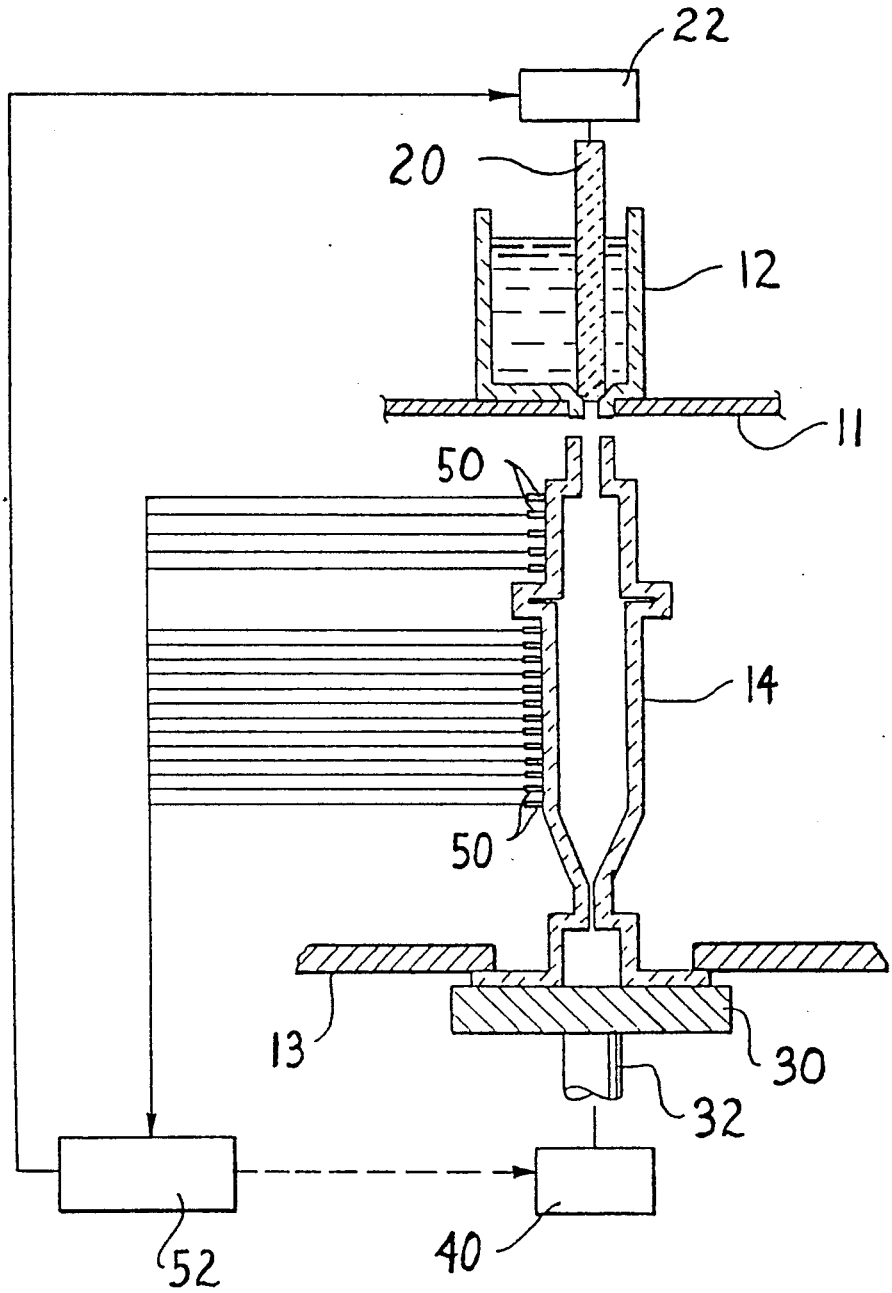
FIG. 5 is similar to FIG. 1 schematically illustrating a process control system for use with the apparatus of FIG. 1 for controlling melt fill rate and solidification rate.

Referring to FIG. 5, one embodiment of the invention controls the second, lower mold fill rate in response to the detected position of the solidification front relative to the mold in order to match the second mold fill rate to the molten alloy solidification rate; i.e. in order to control the second mold fill rate generally equal to the solidification rate. For example, a plurality of temperature sensors 50 are shown disposed at spaced apart locations along the vertical length of the mold 14 to detect the temperature differential associated with the solidification front F and thus its location. The temperature sensors can comprise thermocouples or eddy current detectors on or in the mold wall.

In one embodiment of the invention, the temperature sensors 50 send signals representative of the sensed position of the solidification front F to a computer process controller 52 that, in turn, controls the actuator 22 to maintain the second mold fill rate generally equal to the solidification rate occurring in the molten alloy. Control of actuator 22 controls the stopper rod position relative to the crucible opening 12*a* to control the second melt fill rate.

In another embodiment of the invention, the temperature sensors 50 send signals representative of the sensed position of the solidification front F to a computer process controller 52 that, in turn, controls the actuator 22 and actuator 40 in a manner to generally match the second mold fill rate and the molten alloy solidification rate. Control of actuator 22 controls the stopper rod position relative to the crucible opening 12*a* to control the second mold fill rate, while control of actuator 40 controls the withdrawal rate of the molten alloy-filled mold 14 and thus the molten alloy solidification rate in the mold. The mold fill rate and the solidification rate thereby can be matched in accordance with the invention.

The method of the present invention is advantageous in that improved casting dimensional control is achieved by reducing mold stresses and alloy/mold reactions are reduced by reducing liquid alloy/mold exposure or contact time. Moreover, the invention can provide improved control of molten alloy solidification rates and casting crystal orientation with improved casting cleanliness attributable to bottom pouring of the molten alloy into the mold.

While the invention has been described in terms of specific illustrative embodiments thereof, it is not intended to be limited thereto but rather only to the extent set forth hereafter in the following claims.

The embodiments of the invention in which an exclusive property or privilege is claimed are defined as follows:

1. A method of making a directionally solidified casting, comprising:

introducing a metallic melt into a mold cavity at an initial mold fill rate to only partially fill said mold cavity with said melt while said mold cavity resides in a casting furnace, propagating a solidification front in a direction through the melt to provide a solidification rate, and introducing the remaining melt into said mold cavity at a second mold fill rate less than the first mold fill rate as the solidification front propagates through the melt to further fill the mold cavity with the melt, said second mold fill rate corresponding generally to the melt solidification rate.

2. The method of claim 1 wherein said mold fill rate is controlled to correspond to said solidification rate so as to maintain the solidification front in a substantially constant location relative to a horizontal reference plane.

3. The method of claim 1 wherein the melt is introduced at said initial mold fill rate until about 10 to about 25% of the volume of a mold cavity is filled.

4. The method of claim 1 including mounting a mold defining said mold cavity on a chill member that extracts heat unidirectionally from the melt in the mold cavity to form a liquid/solid interface in said melt, said interface constituting said solidification front.

5. The method of claim 1 wherein said solidification front propagates through the melt to provide a solidification rate controlled by the rate of withdrawal of the melt-filled mold cavity from the casting furnace.

6. The method of claim 1 wherein said solidification front propagates through the melt to provide a solidification rate controlled by reducing heat input to the melt in the mold cavity.

7. The method of claim 1 wherein the melt is introduced into the mold cavity by releasing the melt from a bottom opening of a crucible into the mold cavity disposed beneath the crucible, said mold fill rate being controlled by a stopper rod position relative to said opening.

8. A method of making a directionally solidified casting, comprising:

introducing a metallic melt into a mold cavity at an initial mold fill rate to only partially fill said mold cavity with said melt while said mold cavity resides in a casting chamber, propagating a solidification front in a direction through the melt to provide a solidification rate, and introducing the remaining melt into said mold cavity at a second mold fill rate less than the first mold fill rate as the solidification front propagates through the melt to further fill the mold cavity with said melt, said second mold fill rate being controlled in response to the position of the solidification front relative to the mold so as to correspond generally to said solidification rate.

9. The method of claim 8 including detecting the position of the solidification front relative to the mold by sensing the temperature of said melt at a plurality of locations of the mold.

10. The method of claim 8 wherein the melt is introduced at said first mold fill rate until about 10 to about 25% of the volume of a mold cavity is filled.

11. The method of claim 8 wherein said solidification front propagates through the melt to provide a solidification rate controlled by withdrawal of the melt-filled mold cavity from the casting chamber.

12. The method of claim 8 wherein said solidification front propagates through the melt to provide a solidification rate controlled by reducing heat input to the melt in the mold cavity.

13. The method of claim 8 wherein the melt is introduced into the mold by releasing the melt from a bottom opening of a crucible into the mold disposed beneath the crucible, said mold fill rate being controlled by a stopper rod position relative to said opening.

14. The method of claim 8 wherein said mold fill rate is controlled to correspond to said solidification rate so as to maintain the solidification front in a substantially constant location relative to a horizontal reference plane.

15. A method of making a directionally solidified casting, comprising:

introducing a metallic melt into a mold cavity at a first mold fill rate to only partially fill said mold cavity with said melt while said mold cavity resides in a casting chamber and introducing the remaining melt into said mold at a second lower mold fill rate less than the first mold fill rate as the mold cavity is withdrawn from the casting chamber until the mold is filled with said melt, the second mold fill rate and the mold withdrawal rate from the casting chamber being controlled in response to the position of the solidification front relative to the mold to generally match said second mold fill rate and said solidification rate.

16. The method of claim 15 including detecting the position of the solidification front relative to the mold by sensing the temperature of said melt at a plurality of locations of the mold.

* * * * *